United States Patent [19]

Mosser et al.

[11] Patent Number: 4,592,958

[45] Date of Patent: Jun. 3, 1986

[54] COATED PART, COATING THEREFOR AND METHOD OF FORMING SAME

[75] Inventors: Mark F. Mosser, Sellersville; Alfred E. Simmons, Jr., Harleysville, both of Pa.

[73] Assignee: Sermatech, Limerick, Pa.

[21] Appl. No.: 458,975

[22] Filed: Jan. 18, 1983

[51] Int. Cl.[4] ..... B32B 15/00

[52] U.S. Cl. ..... 428/432; 204/56 R; 427/376.4; 428/469; 428/470; 428/471; 428/472; 428/704; 428/698; 428/699

[58] Field of Search ..... 428/469–472, 428/698, 699, 704, 432; 204/56 R; 427/376.4

[56] References Cited

U.S. PATENT DOCUMENTS

| | | | |
|---|---|---|---|
| 3,248,249 | 4/1966 | Collins | 106/286 |
| 3,248,251 | 4/1966 | All et al. | 106/286 |
| 3,293,158 | 12/1966 | McNeil et al. | 204/56 |
| 3,443,977 | 5/1969 | Bennetch | 106/302 |
| 3,834,999 | 9/1974 | Hradcovsky et al. | 204/56 R |
| 3,857,717 | 12/1974 | Wydra et al. | 106/286 |
| 3,869,293 | 3/1975 | Brumbaugh | 106/14 |
| 3,922,396 | 11/1975 | Speirs et al. | 148/6.16 |
| 4,143,205 | 3/1979 | Rowe et al. | 148/6.152 |
| 4,184,926 | 1/1980 | Kozak | 204/32 R |

*Primary Examiner*—Edith Buffalow
*Attorney, Agent, or Firm*—Weiser & Stapler

[57] ABSTRACT

A coating for imparting, temperature and abrasion resistant properties to a part including at least one layer comprising electrolytically rectifiable material adhered thereto, and a layer including an oxide, preferably $SiO_2$, in a glassy state, and the article formed thereby.

19 Claims, 2 Drawing Figures

Figure 1:
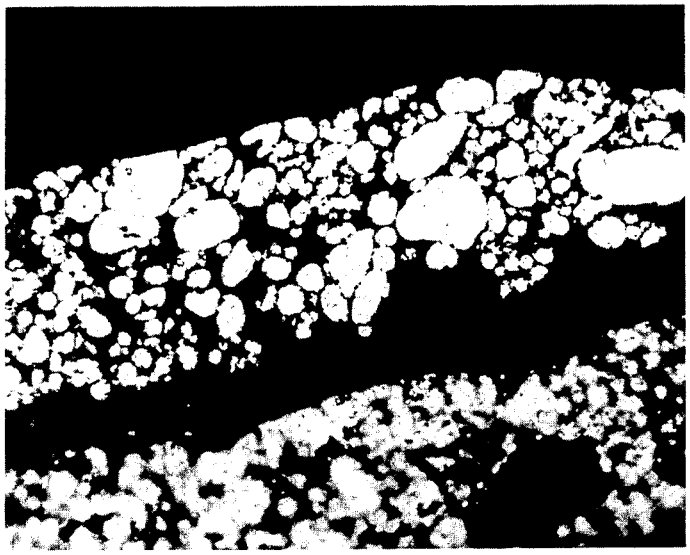

Silicodized layer at 1000X.

COATED PART, COATING THEREFOR AND METHOD OF FORMING SAME

This invention relates generally to hard, corrosion and abrasion resistant coatings, coated articles, and more specifically to coatings which include a glassy oxide layer. The invention also relates to parts (or substrates) coated with such coatings and a process for making same.

It is known to employ an electrolytic process to form a hard, corrosion resistant, glassy oxide layer on metals, as is evidenced by the disclosures in U.S. Pat. Nos. 3,832,293 and 3,834,999 (the "'999 patent") (both to Hradcovsky et al); 4,082,626 (Hradcovsky) and 4,184,926 (Kozak). These processes are commercially feasible for use in producing a layer directly on metals which inherently possess electrolytically rectifiable properties, such as aluminum, magnesium, titanium and other light metals. Such processes are often referred to as "silicodizing" processes.

U.S. Pat. No. 3,248,251 issued to Charlotte Allen relates to coating compositions consisting essentially of a slurry of solid inorganic particulate material (especially aluminum) in an aqueous acidic solution containing substantial amounts of dissolved metal chromate (dichromate), or molybdate, and phosphate. After application of a coating to the substrate, it is heated to a temperature upwards of about 500° F. until the coating is water insoluble.

U.S. Pat. No. 3,293,158 to William McNeill et al discloses a process for coating metals by anodic spark reaction. There is noted that spark reactions were not obtained with Mg, Ni, Co and Fe.

U.S. Pat. No. 3,869,293 of Robert J. Brumbaugh provides a coating composition similar to the composition of '251 Allen which utilizes as the solid particulate material an alloy comprising aluminum and magnesium so as to further improve the corrosion resistance of the coating.

Various other chemical and electrochemical processes have been used in attempts to provide a durable, protective coating for metals and their alloys. The more effective procedures for coating metals have been especially with those metals which exhibit electrolytic rectification. Metals which show an electrolytic rectification effect at low as well as high voltages and are termed "intrinsic rectifier metals" are Mg, Ta, Al, Ti, Nb, Ca, Zr, Hf, La, Mn, Ru, V and their alloys. Metals which show this effect only at high voltages (above 600 volts) and are termed "induced rectifier metals" are Fe, Ni, Cr, Co and their alloys, including the steels.

It should be noted that the term "metal" is used herein to denote both elementary metals and alloys.

Electrochemical methods for coating steel surfaces in an extremely short time in dichromate solution containing phosphoric acid or in chromic acid solution containing boric acid, borate or phosphoric acid are known. However, such procedures do not produce thick, dense and hard oxide coatings which are capable of withstanding abrasion and corrosion. U.S. Pat. No. 3,400,058 of Edward C. Ross et al notes the problem of forming a successful coating on iron and steel.

In the article "Anodic Spark Reaction Products in Aluminate, Tungstate and Silicate Solutions" by Leonard L. Gruss et al, *Electrochemical Technology,* Vol. 1, pages 283–287, it is noted that anodic spark reaction products did not occur with iron anodes.

In U.S. Pat. No. 2,855,350 to Robert Ernst there is disclosed a procedure of producing an oxide coating on aluminum and aluminum alloys by electrolytic oxidation. There is noted that the presence of copper and iron ions materially affects some electrolytic baths because the appearance of the ions requires an increase in current density which results in corrosion, that is, burning of the part being oxidized.

Additionally, the electrolytic processes described in the earlier referenced patents to Hradcovsky et al, Hradcovsky and Kozak, all of which are herein incorporated by reference, are known to provide a substantially hard, abrasion resistant glassy oxide surface on metal parts at high voltages. However, until the present invention, these processes were not considered commercially feasible for coating steels, iron, glass or ceramic material.

Accordingly, it is an object of the present invention to provide a means for coating rectifier metals, especially those which show an electrolytic rectification effect only at high voltage, as well as inorganic nonmetal structures, such as of glass and ceramic material, so as to have a glassy oxide surface.

It is a further object of the present invention to apply to a substrate a coating that is strongly resistant to corrosion and abrasion.

Another object of the invention is to improve the corrosion resistant properties of chromate/phosphate coatings of the type disclosed in the '251 Allen patent.

A still further object of the invention is to provide a glassy oxide layer on coated metal surfaces so as to improve their corrosion and abrasion resistant properties.

It is a yet still further object of the present invention to provide steel and other difficult to electrolytically coat surfaces with a glassy oxide coating.

In accordance with the present invention, there is provided a substrate with a coating having corrosion, temperature, and abrasion resistant properties wherein said coating comprises a first layer on the substrate which is electrically rectifiable, and a second layer on said first layer comprising a substantially uniform, dense layer of an oxide in a glassy state. Preferably, the second layer of the coating is a silica layer.

In accordance with a preferred embodiment of this invention, the first layer is formed by employing a chromate/phosphate solution in which electrolytically rectifiable metal particles are dispersed therein and this solution is heat curable to a substantially water-insoluble state, whereby the electrolytically rectifiable particles are bonded therein.

In the preferred embodiments of the invention, chromate/phosphate acid coating solution with the electrolytically rectifiable particles therein (e.g. aluminum powder) is applied to the desired surface to be protected. After the coating has been dried and cured to render it substantially water insoluble in accordance with the invention, a second layer is placed thereon utilizing a low voltage electrolytic process, preferably a silicodizing process. The chromate/phosphate coating compositions which are useable in this invention, as well as the various methods of applying the coating to parts are described in the '251 patent to Allen.

The present invention is most useful in coating parts that are electrolytically non-rectifiable or are considered non-rectifiable at low voltages and for improving the abrasion and corrosion resistance characteristics of previously coated parts.

Surprisingly, high voltages (on the order of 600 volts or more) are not needed to carry out the electrolytic process employed in the invention to form the glassy oxide layer on the first layer. However, such high voltages are required when attempting to directly silicodize the exposed surfaces of induced rectifier metals, as is disclosed in the '999 patent issued to Hradcovsky et al.

In the instant invention, the part to be coated, whether electrolytically rectifiable or non-rectifiable, is provided with a first layer which is electrolytically rectifiable, preferably one formed with a chromate/-phosphate composition that has been heat cured to form a substantially water insoluble material with electrolytically rectifiable metal particles dispersed therein, although other surface coating methods may also be employed as will hereinafter be described. Thereafter, the second layer (the oxide layer) is applied on the first by means of an electrolytic process (e.g. silicodizing process) utilizing low voltages.

If necessary, a further protective coating may be added on the oxide layer, for example, a chromate/-phosphate layer.

Other objects and advantages of this invention will become apparent by referring to the following description, taken in conjunction with the drawings including a representative coating in accordance with the present invention.

Figure 2:
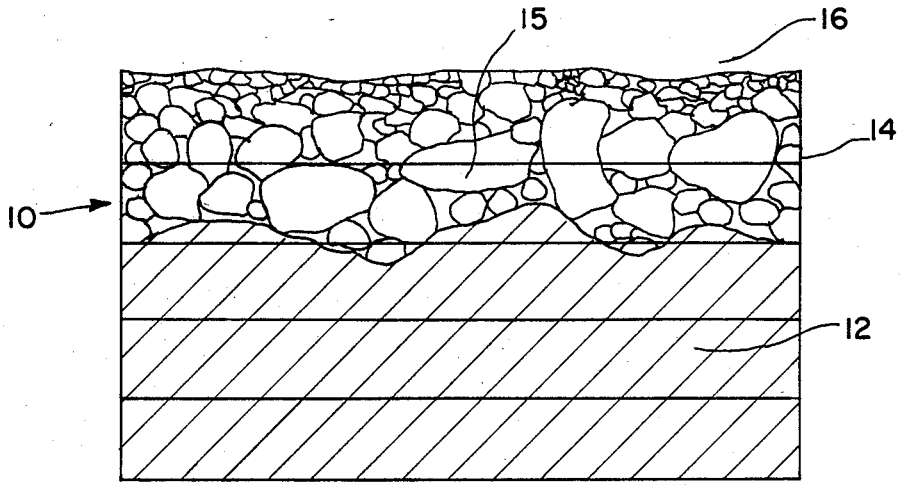

FIG. 1. is a microphotograph of a coating of this invention on a steel substrate, and FIG. 2 is an illustration of a coating of this invention.

Although the coating of this invention can be employed to impart excellent corrosion, temperature and abrasion resistant properties to parts made of various materials, it has its most beneficial use in coating parts formed of electrolytically non-rectifiable materials, such as glass and ceramic material, and high voltage rectifiable metals, such as metals selected from the group consisting of steel, iron, nickel, chromium, cobalt and alloys thereof. It is in connection with parts made of high voltage rectifiable materials that the greatest problem, or difficulty has been encountered in forming a protective coating. The present invention, therefore, contributes to solving this problem.

The first layer of the invention may be formed utilizing coating procedures such as hot dipping, thermal spray coating, including plasma spraying, cladding, vacuum deposition, ion vapor deposition, electroplating and electrophoretic deposition.

The hot dip coating process can be performed by a number of processes. The Sendzimir method, which is the most widely used for sheet material, consists of oxidizing the surface of the steel, reducing the oxidized surface in a reducing atmosphere, and immersing the product in molten aluminum. This procedure expedites wetting, or formation of the alloy between the aluminum and the product, which is preferably steel.

According to the thermal spray coating method, sprayed metal coatings are obtained by melting metal wire with an oxyacetylene flame or by electrical resistance, and then atomizing the droplets and propelling them, by use of an air blast, against the surface to be coated. Upon impact with the surface, the droplets deform to flattened or flake-like particles. The coating has a theoretical density of 85 to 90% and an oxide content of 0.5 to 3.0%. Spraying to a coating thickness of 230 μm (9 mils) eliminates continuous pores. Heating to above 480° C. (900° F.) metallurgically bonds the coating to the substrate.

Cladding of a substrate can be performed with aluminum by either hot or cold rolling. A clad sheet can be prepared by using 0.06% carbon steel on which an aluminum sheet containing about 0.7% silicon is hot rolled at about 200° C. (400° F.) to a 40% reduction. The aluminum and substrate surfaces are roughened by scratch brushing before rolling. No intermediate anneals are required, and the final anneal should be controlled at 530° to 550° C. (995° to 1020° F.).

Vacuum deposition or vacuum metallizing is widely used for depositing very thin coatings of aluminum on substrates. Because the coatings are very thin, less than 2.6 μm (0.1 mils), this process is not often used to apply aluminum coatings on steel for functional reasons.

The ion vapor deposition of aluminum is similar to the conventional vacuum metallizing process used for applying aluminum to a substrate for decorative purposes in that aluminum is vaporized and allowed to condense on the surface of the parts being coated.

The denser, more adherent coating from ion vapor deposition is obtained by applying a high negative potential between the part being coated and the source of evaporation. An inert gas is introduced into the vacuum system and becomes ionized. The positively charged ions are attracted to the negatively charged part surface, and their bombardment of the surface performs final cleaning.

Following glow discharge cleaning, aluminum is evaporated. As it passes through a glow discharge region, a portion of it becomes ionized and is accelerated toward parts. This results in denser coatings and also contributes to better adhesion. Ionization also provides better throwing power and allows complex shapes to be uniformly plated.

Aluminum is electroplated on a substrate by the use of anhydrous electrolytes composed of fused mixtures of aluminum chloride and alkali chlorides. Pure chemicals and high-purity aluminum anodes are required, because all metallic impurities below aluminum in the electromotive series interfere with the production of a smooth, bright, adherent coating. This type of coating is free from any interfacial alloy layer.

A typical fused-salt electrolyte contains 80% aluminum chloride and 20% sodium chloride, and is operated at 180° C. (350° F.) and at a current density of 15 A/ft$^2$. Higher current densities may be used if the bath is agitated.

Aluminum chloride must be added frequently to maintain proper concentration. Aluminum can be electroplated also from several anhydrous organic electrolytes. Another plating bath consists of aluminum chloride and lithium hydride (or lithium aluminum hydride) in an ethyl ether solvent. Preferably, a deposition rate of 25 μm (1 mil) to 50 μm (2 mil) per hour is used.

Another process for coating aluminum is based on the electrophoretic deposition of aluminum powder from a bath of spheroidal aluminum particles in alcohol. This powder is consolidated into a solid layer by rolling (at least 7% reduction) and is then sintered and bonded to the steel by heating slowly at 500° C. (930° F.).

Although the coating processes described are ideally suited for forming aluminum and aluminum alloy layers, other metals and/or metal alloys can be utilized from the aforementioned group of intrinsic rectifier metals, preferably, magnesium, tantalum and niobium. *Metals Handbook Ninth Edition,* Vol. 5, p. 333–347 entitled "Surface cleaning, finishing and coating," American Society for metals, and *Flame Spray Handbook,* Vol. III published by Metco Inc., Westbury, N.Y., which are incorporated herein by reference, disclose typical procedures which may be utilized for forming the first layer with an electrolytically rectifiable characteristic.

In accordance with a preferred feature of the invention, metal particles or metal powders provide this electrolytically rectifiable feature of the first layer. Preferably, the metal particles for the coating are dispersed in an aqueous binder which is applied to the substrate. Application can be by any suitable means known in the art, such as dipping, spraying, brushing and the like. If desired, the technique of dip-spinning may be used to apply the liquid carrying the metal particles onto the part. A class of binders for applying the metal particles which is especially suitable is comprised of phosphate anions and chromate (or dichromate) and/or molybdate anions. A variety of such solutions is known for treatment of metal surfaces. For instance, Kirk and Othmer, *Encyclopedia of Chemical Technology*, 2nd ed., Vol. 18, Interscience Publishers, John Wiley & Sons, Inc., 1969 (pages 292–303), describes phosphate and chromate coatings. The United States patents literature describes coating solutions or dispersions for protective coating of metals, which compositions are suitable for supplying the metal particles to the porous part. Such compositions are disclosed by Allen (U.S. Pat. No. 3,248,251); Brumbaugh (U.S. Pat. No. 3,869,293); Collins (U.S. Pat. No. 3,248,249); Wydra (U.S. Pat. No. 3,857,717); Boies (U.S. Pat. No. 3,081,146); Romig (U.S. Pat. No. 2,245,609); Helwig (U.S. Pat. No. 3,967,984); Bennetch (U.S. Pat. No. 3,443,977); Hirst (U.S. Pat. No. 3,562,011) and others. These disclosures are incorporated herein by reference. Other illustrative patents or literature showing corrosion-inhibiting and protective coating compositions of phosphates, mixtures of phosphates and chromates and/or molybdates are known to one skilled in the art and further examples need not be supplied.

The pH of the aqueous binder used herein is preferably but not necessarily in the range of about 1.0 to about 3.0. It is preferable that the aqueous binder contain a high proportion of metallic particles in forming the first layer of the invention.

It is preferable that the binder is of a curable type which will cure to a film prior to adding the oxide layer.

As can be seen from the above, considerable leeway and choice is available in the nature of the chromate/-phosphate solutions. Certain compositions are preferred, however. Thus, it should be pointed out that in the preparation of the composition for forming the chromate/phosphate layer, the +2 and +3 valence metals are preferably used to introduce metal ions into the chromate/phosphate solution. Magnesium has been found to be outstanding for this purpose; however, zinc ion also is desirable. To achieve optimum bonding of the second layer to the first layer and optimum corrosion resistance of the entire coating, it is preferable that the metal ion concentration be at least about 0.5 moles per liter. Further, where the metal cation is all valence +2 or +3, and especially for magnesium, as is preferred, it has been found desirable that the molar concentration of the metal ion not substantially exceed about one-half the total of the molar concentration of the phosphate and chromate (and/or molybdate) ions. At the same time, however, it is desirable that the metal ion concentration be at, or approach, this ratio of one mole per every two moles of phosphate plus chromate (and/or molybdate). For example, in the most preferred compositions where all the metal cations are +2 valence, specifically magnesium, the molar concentration of metal to phosphate to chromate is about 2 to 3 to 1.

FIG. 1 is a detailed microphotograph of the composite coating showing the anodized layer on an aluminum filled ceramic coating. For visual clarity of the photograph another layer was added on top of the coating. In the illustrated embodiment the coating is shown on a carbon steel panel.

FIG. 2 illustrates the coatings of this invention wherein it will be noted that a coated part (10) is formed with a chromate/phosphate layer (14) adhered on a substrate (12). Metal particles (15) are dispersed throughout this first layer. On top of this first layer is the oxide layer (16) which has been applied by the electrolytic procedure of this invention.

In accordance with a preferred method of this invention, the coating is established, or formed in a two stage operation. First, a chromate/phosphate binder, including electrolytically rectifiable particles (e.g. aluminum powder and alloys) therein, is applied to the part to be coated, such as by spraying, dipping or other suitable technique. The liquid binder in which the metal particles are dispersed is for illustrative purposes an aqueous acid solution of a combination of inorganic compounds from the group consisting of phosphoric acid, chromic acid, molybdic acid and the metal salt of said acids. The combination of compounds in said solution is preferably but not necessarily such as will provide at least 0.1 mole per liter dissolved phosphate, more preferably 0.5 mole per liter, at least 0.2 mole per liter from the group consisting of chromate and molybdate, and optionally, at least 0.5 mole per liter dissolved metal. Preferably, the rectifiable metal particles dispersed in the binder have a grain size less than 325 mesh, and in the most preferred embodiment of this invention are aluminum powder (atomized 4–10 micron), present in an amount of from about 10 to 2000 grams per liter of the solution. Most preferably, the concentration of aluminum powder is from about 600 to 800 grams per liter of solution.

It is noteworthy that in accordance with the invention, a greater latitude is provided in the type of phosphate compositions which can be used. For instance, with respect to the above-mentioned Allen patent (U.S. Pat. No. 3,248,251), it is not necessary that the phosphate binder be confined to the various concentrations and other molar relationships disclosed by that patent. The present invention, therefore, allows for the use of a large number and a great variety of acid binder solutions for making the coating composition in accordance with the invention.

In accordance with the invention, a stable first layer coating composition of the invention comprises an acid binder, which comprises phosphate ions and ions of the group of chromate or molybdate ions, with rectifiable metal particles dispersed therein. Preferably, the metal particles are of the type which show an electrolytic rectification effect at low as well as at high voltages as were herein before disclosed. Most preferably the metal is aluminum and its alloys. However, any combination of metals may be utilized depending upon the requirements.

In accordance with the invention, there is provided the liquid acid solution (which contains the phosphate ions) and the particulate metallic material, which preferably is aluminum, for use in forming a first layer on a substrate.

A preferred manner of forming a first layer of the coatings of the invention is to admix the particulate metal material into the chromate/phosphate and/or molybdate-containing binder under vigorous mixing conditions.

The sequence of addition of the components of the phosphate solutions is not critical either, as is disclosed in the prior art, for instance the Allen patent (U.S. Pat. No. 3,248,251).

After the chromate/phosphate coating has been applied to the part or substrate, it is heat cured to form a substantially water-insoluble material with the electrolytically rectifiable metal particles firmly bonded therein.

The application of the chromate/phosphate coating and heat curing may be performed one or more times depending on the thickness of the layer desired.

It is understood that other particulate materials may be added to the binder prior to mixing in amounts depending on the specific characteristics desired for the layer such as graphite, refractory metal oxides, refractory carbides, nitrides, silicides and borides, and metal carbides, nitrides, silicides and borides.

The following are representative compositions of chromote/phosphate first layer coatings useable in the invention. The invention is not limited in any way by these examples, which are provided only by way of illustration.

EXAMPLE 1

A composition for use in preparing a first layer of the coating of the invention of the type disclosed by Allen (U.S. Pat. No. 3,248,251) is prepared by mixing the following components:

| | |
|---|---|
| $MgCr_4 7H_2O$ | 266 g |
| $H_3PO_4$ | 98 g |
| $Mg(H_3PO_4)_2 3H_2O$ | 272 g |
| $H_2O$ to 1000 cc | |
| Aluminum powder (atomized, 5–10 micron) | 600 g |

The prepared composition may be coated on ordinary steel stock (SAE 1010 steel) by spraying, drying at 175° F. and then curing at about 625° F. for 15 minutes. However, any other suitable substrate may be used in place of the steel, i.e. nickel, chromium, copper, glass, ceramic, etc.

Similarly, there may be prepared a composition wherein magnesium chromate is replaced by any one of the following chromate-containing compounds:

| | |
|---|---|
| Chromic acid | $H_2CrO_4$ or $CrO_3$ |
| Magnesium dichromate | $MgCr_2O_7$ |
| Zinc chromate | $ZnCrO_4$ |
| Zinc dichromate | $ZnCr_2O_7$ |
| Calcium dichromate | $CaCr_2O_7$ |
| Lithium dichromate | $Li_2Cr_2O_7$ |
| Magnesium dichromate plus sodium dichromate | |

EXAMPLE 2

Following the procedure of Example 1, a binder for use in forming the first layer of the coating of the invention or as a protective top coating is prepared as follows:

| Binder | |
|---|---|
| MgO | 6.0 g |
| Chromic acid | 10.4 g |
| Phosphoric acid (85%) | 20 ml |
| Water | 80 ml |

80 grams of aluminum powder (−325 mesh) is added to the binder with mixing under high shear so as to form the coating composition.

Steel parts such as screws, bolts, and fasteners are dip coated with the composition. The coatings are dried in a drying cycle at 175° F. followed by a curing step at 650° F. for 30 minutes.

EXAMPLE 3

Following the procedure of Example 1, a composition especially useful for forming the first layer of a coating of the invention on a ceramic substrate is prepared as follows:

| | |
|---|---|
| $CrO_3$ | 92 g |
| $H_3PO_4$ | 323 g |
| MgO | 72 g |
| Aluminum powder (atomized, 5–10 micron) | 800 g |
| Water to 1000 cc | |

The ingredients were mixed, coated onto ceramic and cured at 700° F. for 30 minutes.

If desired, other particulate materials may be added to the coating, i.e. graphite (5–10 micron), refractory metal oxides, refractory carbides, nitrides, silicides and borides.

If desired, the part may be repeatedly coated with the composition and cured so as to obtain a layer of desired thickness onto which the glassy oxide is then placed, as will be hereinafter described.

EXAMPLE 4

Another composition was prepared following the procedure of Example 1 with the following ingredients:

| | |
|---|---|
| Chromic acid | 35.97 g |
| Zinc oxide | 16.26 g |
| Phosphoric acid (85%) | 64 ml |
| Water to 1000 cc | |
| Aluminum powder (−325 mesh, 4–6 micron average particle size) | 600 g |

This composition was applied to phosphated steel fasteners using a "dip spin" apparatus, then cured at 525° F. for 10 minutes.

A second coating was then applied and cured likewise so that the two coatings formed the first layer onto which the glassy oxide layer is then placed.

EXAMPLE 5

Example 4 was repeated, but there was added, in addition to the aluminum powder, magnesium-/aluminum alloy (30/70) powder.

EXAMPLE 6

A first layer for a stainless steel substrate is prepared utilizing a composition of the type disclosed by Wydra (U.S. Pat. No. 5,857,717). No cations are added but phosphorous acid is used to react with some of the chromic acid producing trivalent chromium and phosphoric acid in situ.

| | |
|---|---|
| $H_2O$ (deionized) | 295 g |
| $H_3PO_4$ (85%) | 87 g |
| $H_3PO_3$ | 42 g |
| $CrO_3$ | 62 g |
| Aluminum powder (atomized, particle size 4–6 micron) | 400 g |

The composition may be applied to the substrate by a spray gun according to the procedure of Wydra to obtain a layer thickness of 0.1 mm. This coating is dried by heating at 50° C. for about one-half hour then cured at 400° C. for 1 hour.

The steel substrate which can be utilized is any one of the AISI standard alloy steel compositions including the Mn steels, Ni steels, Ni-Cr steels, Mo steels, Cr-Mo steels, Ni-Mo steels, Cr steels and Cr-V steels.

The following are illustrations of the silicodizing process applied to coated samples.

The silicodizing process is electrolytic and is based on a capacitive discharge system. The solution employed in the preferred process is essentially a dilute, water-based potassium silicate material which may or may not have other additives in it.

The following are typical solutions and procedures that may be useable in this invention to form the glassy oxide layer.

EXAMPLE 7

The silicodizing process of the invention is illustrated by the use of the part of Example 1 as an anode to provide a non-porous coated article. The anode is immersed in a bath having the following composition:

| | |
|---|---|
| Sodium silicate (52° Be.) | 35 g |
| Sodium hydroxide (granular) | 25 g |
| Sodium tellurate catalyst | 1 g |
| Water | 1000 g |

Using an iron rod as the cathode and a direct current source, an initial potential of 50 volts produces a current of 500 ma.

The current flow rapidly drops as a film at the anode thickens, and after one minute the current is 10 ma. Further increasing the voltage to 200 volts produces a current of 50 ma. Five minutes after the initial application of DC voltage the potential difference is increased to produce a spark discharge at the anode surface. The spark discharge produced at the anode surface is sufficient to coat the substrate; however, the voltage is further increased to about 350 volts to melt the material of the film at the anode surface, whereby a smooth layer of pore-free silicate-containing material is formed on the anode. The process can be stopped at this point and the anode removed. After six minutes of treatment with applied potential at 400 volts the thickness of the protective layer is about 0.2 mm.

A bath having the composition of Example 7 produces a milk-white coating which is too hard to be scratched by glass. Thin coatings produced with the bath composition and voltages applied as described in this Example are smooth to the touch.

Baths having other constituents and concentrations within the scope of the present invention can be utilized in generally the same manner to provide protective or other useful coatings having a variety of characteristics, as will be clear from the present description. Essentially, the electrolytic baths used for coating rectifier metals comprise aqueous mixtures of an alkali metal silicate, alkali metal hydroxide, and an oxyacid catalyst of tellurium, selenium, or a mixture of such oxyacids. The oxyacid catalyst is added in the form of an alkali metal salt thereof.

Preferably, the quantity of catalyst ranges from 0.01 to about 10 grams per liter of water in the electrolyte.

The following are examples of suitable solutions that may be used in the procedure of Example 7.

EXAMPLE 8

| | |
|---|---|
| $K_2SiO_3$ | 30 g |
| KOH | 150 g |
| $H_2O$ | 1000 g |

EXAMPLE 9

| | |
|---|---|
| $K_3PO_4$ | 50 g |
| $KHCO_3$ | 50 g |
| KOH | 20 g |
| $K_2SiO_3$ | 20 g |
| $H_2O$ | 1000 g |

EXAMPLE 10

| | |
|---|---|
| $Na_2WO_4$ | 70 g |
| NaOH | 100 g |
| $H_2O$ | 1000 g |

EXAMPLE 11

| | |
|---|---|
| $KBO_4$ | 50 g |
| KOH | 30 g |
| $H_2O$ | 1000 g |

EXAMPLE 12

| | |
|---|---|
| $(NH_4)_6Mo_7O_{24}4H_2O$ | 20 g |
| KOH | 20 g |
| $K_2SiO_3$ | 20 g |
| $H_2O$ | 1000 g |

EXAMPLE 13

| | |
|---|---|
| $SnO_2$ | 10 g |
| $Na_2SiO_3$ | 10 g |
| NaOH | 20 g |
| $H_2O$ | 1000 g |

EXAMPLE 14

| | |
|---|---|
| $Sb_2O_5$ | 15 g |
| $K_2SiO_3$ | 10 g |
| KOH | 5 g |
| $H_2O$ | 1000 g |

Other compounds which may be used for the same purpose when dissolved in water and brought to a pH ranging from weakly acidic to alkaline are the tungstate-silicate $SiO_2.12WO_3.8KOH.10H_2O$, the tungstate-borate $H_3BO_3.12WO_3.5KOH.14H_2O$, the tungstate-phosphate $H_3PO_4.12WO_3.KOH.2.5H_2O$, the tungstate arsenate $H_3AsO_4.9WO_3.3KOH.4H_2O$, sodium tungstate, sodium silicate, sodium or potassium tetraborate and boric acid made alkaline with potassium or sodium phosphate.

Suitable combinations of compounds are ammonium molybdate with potassium tungstate and potassium borate with potassium tungstate. In general, the solution must contain at least one oxidic anion from which a glassy oxide can be formed by the removal of one or more oxygen atoms. Thus, the borate and the silicate ions can yield $B_2O_3$ and $SiO_3$ in a glassy state.

EXAMPLE 15

Following the procedure of Example 7, the initally coated articles of any one of Examples 2–6 may be substituted as the anode component, and any one of the baths described in Examples 7–15 may be utilized to form the glassy oxide layer which, in combination with the initial layer or layers, forms the protective coating of the invention.

If desired, a top coating may be added utilizing the binder of either Examples 2 or 6.

The solution used in Examples 7–15 is contained within a metal tank, typically stainless steel, with available bus bars for electric attachment; the tank and power supply for the test work carried out in this invention was a 15 kilowatt DC rectified power source. However, it is also possible to use AC power. The parts are electrically connected (with the part to be coated constituting the anode), immersed in the bath and the power applied for a brief period of time (on the order of about 2 seconds). The voltage is raised to a level of 225 to 250 volts wherein the current rises rapidly to about 50 amps for a 2 inch ×4 inch panel precoated with the coating described in any one of Examples 1–7. Once the surface activity has stabilized, the voltage is then raised to about 300 volts. During this process there is a sparking discharge effect across the entire surface of the part to be coated. When the part is removed from the bath it is covered with a white, insoluble glassy layer that actually gets harder as it continues to set. Any residues from the bath that may be retained on the part simply can be rinsed off with water. The spark discharge voltage will depend on the type of rectifiable metal utilized, generally it is within the range of 150 to 500 volts, preferably 290 to 400 volts.

The smoothness of the formed surface tends to be related to the smoothness of the starting surface, and a rapid ramping of the current voltage seems to produce a smoother resultant surface after the silicodizing process.

The above described silicodizing process was carried out on carbon steel panels (e.g. FIG. 1) initially provided with the chromate/phosphate coating compositions described in earlier-reference Example 1. The chromate/phosphate coatings were from about 1 mil to about 1.5 mils thick, and were mechanically burnished or polished to make them conductive. After application and treatment of the chromate/phosphate coatings, the panels were subjected to a silicodizing process in a dilute potassium silicate solution. The silicodizing process was carried out to add an additional 0.2 to about 0.3 mils of a substantially uniform, dense, continuous glassy $SiO_2$ layer onto the layer of the chromate/phosphate coating. This dense layer was topped by as much as 1 mil of a porous, substantially open structure. The surface finish after silicodizing was consistently 60 to 75 microinches.

EXAMPLE 16

A specimen of aluminized steel (5 to 11%) silicon alloy, having a surface area of $50cm^2$ was cut and the bare edges masked. The sample was placed in a bath of the composition described in Example 7 as the anode. The voltage was increased to maintain a 5 amps current flow; a voltage of 150 volts was achieved in two minutes. A glow was observed on the surface of the aluminized steel. Anodic spark discharge occured at 180 volts. Voltage was increased to 300 volts and held for three minutes. The resulting coating on the sample was smooth and highly resistant to corrosion.

EXAMPLE 17

Another example of aluminized steel with the coating containing no silicon was treated in the same bath under the same conditions. The resulting coating was smooth and very hard.

EXAMPLE 18

A panel of aluminized zinc alloy (Galvalume, Bethlehem Steel Corp.) of a composition of 55% aluminum, 43.4% zinc and 1.6% silicon was subjected to this same treatment as described in Examples 16 and 17. The treated panel had a very smooth coating and highly satisfactory corrosion resistance.

EVALUATION OF THE COATED PANELS

Carbon steel panels provided with a coating in accordance with this invention were then subjected to testing to evaluate corrosion resistance, temperature stability, high temperature corrosion resistance, abrasion resistance and hardness. In addition, the quality of the surface finish also was evaluated. Each of these properties was qualitatively rated as either Poor, Good, Very High (or Very Good), or Excellent, depending upon the observed and/or obtained results.

A coated panel was exposed to a 5% salt fog for two weeks in accordance with ASTM B117. The coating on the panel did not react, and the results were rated Excellent.

Pieces of a coated panel were heated to different temperatures up to 1100° F. with no adverse effect on the coatings. Quenching these hot panels into cold water also did not damage the coatings. The coating did not fall off when a 1600° F. heated panel was quenched. The results were rated Very Good.

A coated panel was subjected to a ten cycle heat/salt cycling test. Each cycle of the ten cycle test consisted of six hours at 750° F., then two hours at room temperature followed by 16 hours in a 5% salt fog. The appearance of the test specimen did not change throughout the test. An identical panel containing only the chromate/phosphate coating (without silicodizing) became black with spots of white sacrificial products during the same tests. The results were rated Very Good.

Under testing with a SS White Jet-Abrader, it took 43.5 seconds to wear through each mil of a coating of this invention. In comparison, it took only 24 seconds to wear through each mil of a machanically burnished chromate/phosphate coating, without the glassy silicodized layer thereon.

The improved abrasion resistance of the coating of this invention was corroborated in falling sand tests. Specifically, the coating of this invention wore at a rate of 350 to 400 liters of sand per mil. However, a chromate/phosphate coating, by itself, normally wears at the rate of 100 to 130 liters of sand per mil. The results were rated Good.

Tests were carried out to determine the superficial hardness of the coatings of this invention. For this purpose the N scale diamond indentor was utilized at 15 and 30 kg loads. The results of this testing are indicated in Table 1.

TABLE 1

Superficial Hardness of Silicodized Coatings

| | Substrate | 30 N (Rc equiv.) |
|---|---|---|
| Silicodized layer on aluminum base | $R_c$ 22 | 134+ (68) |
| Coating of invention | $R_c$ 45 | 149+ (68) |

+ off scale readings.

Hardness was rated Very High. Results indicate that equivalent hardness can be achieved by using the invention on substrates other than aluminum.

In evaluating the surface finish the coatings were found to be rough (65 to 80 microinches RA at 0.010 cutoff) and were rated Poor for applications requiring smooth coating surfaces. However, the surface finish can be improved by a number of techniques, including employing a vibratory finishing step with a suitable abrasive media or overcoating the material with a suitable sealant.

Several very substantial advantages are achieved in accordance with the instant invention. First, the unique coatings provide twice the unit erosion resistance of current chromate/phosphate coatings of the type disclosed in the '251 patent. This makes the coatings of this invention exceptionally advantageous for use in fabricating parts for the aerospace industry, as well as for fabricating other parts which require greater erosion resistant properties than can be achieved solely by use of chromate/phosphate binders and coatings.

Also, while it has been found that the chromate/phosphate coatings have successfully reduced corrosion problems of parts which are subjected to a chemical environment, the coatings are susceptible to abrasive erosion. This is especially found with axial compressors used to blow air into blast furnaces where very fine particles present in the atmosphere are accelerated to great velocities within the compressor, and wear away the protective coating upon impact with the blades. This very fine erosion condition primarily affects the front two stages of blades by removing the protective coating from the blades, allowing blade corrosion to occur within one year of service. The blades must be removed from service for recoating. Removal of the blades every year could result in blade damage. The present coating provides a solution to this problem.

The coatings of the invention are insoluble in acids, alkalis and alcohol. They are recommended for use in corrosive chemical environments in temperatures up to 950° to about 1000° F., such as found where coke ovens are operating.

The coatings of this invention can also be used in petrochemical industry applications where a ceramic coating resistant to spalling during flexing, as well as having excellent wear resistance, is required. These applications include pump impellers, reciprocating pump compressor rods, centrifugal pump seals and parts. The coatings can also be used for mechanical seal applications and in the textile industry on machine elements which come into contact with fibers and threads where a fine, hard wear and corrosion resistant ceramic coating is required.

Especially advantageous use is found in the aerospace industries where parts are subjected to high temperatures, chemicals and wear. Typically, the coatings can be applied to rocket nozzles, missile nose cones, and engine parts.

The process for applying the coatings to parts in accordance with this invention is not operator intensive and is relatively non-capital intensive. Thus, it does not take either exceptional technical skill or a large amount of capital to be able to set up and operate a manufacturing facility to apply coatings on parts in accordance with the present invention.

Chromate/phosphate coatings in combination with a glassy oxide layer, especially a silica layer, provide excellent resistance to strong acids and strong alkali compounds, while achieving an exceptionally high degree of hardness.

The coatings of this invention can be utilized to impart desired chemical, erosion and abrasion resistant properties to various different parts, the greatest advantage being for use of the coating of parts that are formed of electrolytically non-rectifiable materials, such as metals selected from the group consisting of iron, nickel, chromium, cobalt and alloys thereof (especially steel), as well as other non-rectifiable materials, such as glass and ceramic substrates. The coatings of this invention, as well as the method for applying them, are believed to be applicable for use on a wide range of materials, both electrolytically non-rectifiable and electrolytically rectifiable, including zinc alloys, and most other metals capable of withstanding a 500° F. cure temperature (most transition metals).

Although the invention has been described with reference to the particular embodiments herein set forth, it is understood that the present disclosure has been made only by way of example and that numerous changes may be resorted to without departing from the spirit and scope of the invention. Thus, the scope of the invention should not be limited to the foregoing specification but rather only by the scope of the claims appended hereto.

What is claimed is:

1. A coating on an intrinsic rectifier metal surface or on an induced rectifier metal surface or on a non-metal surface which coating has improved corrosion, temperature and abrasion resistance which coating comprises two layers, a first cured layer which comprises phosphate ions and ions selected from the group consisting of chromate and molybate ions and a rectificable metal bonded therein and a second layer bonded on said first layer by silicodizing at a low voltage, which second layer is a porous oxide layer.

2. The coating of claim 1 wherein the voltage of which the silicodized layer is applied is in the range of 150 to 500 volts.

3. The coating of claim 2 wherein the voltage at which the silicodized layer is applied is in the range of 290 to 400 volts.

4. The coating of claim 1 wherein the coating is on an intrinsic rectifier metal surface and the voltage at which the silicodized layer is applied is not in excess of 400 volts.

5. The coating of claim 1 wherein the coating is on an induced rectified metal surface and the voltage at which the silicodized layer is applied is not in excess of 500 volts.

6. The coating of claim 1 wherein the coating is on a non-metal surface.

7. The coating of claim 4 wherein the intrinsic rectifier surface is selected from the metals of the group consisting of Mg, Ta, Al, Ti, Nb, Ca, Zr, Hf, La, Mn, Ru, V and their alloys.

8. The coating of claim 5 wherein the metal of the induced surface is selected from the metals of the group consisting of Ni, Cr, Co, Fe and their alloys, including steel.

9. The coating of claim 6 wherein the non-metal surface is glass or ceramic.

10. The coating of claim 7 wherein the voltage is in the range of 290 to 400 volts.

11. The coating of claim 8 wherein the voltage is not in excess of 400 volts.

12. The coating of claim 11 wherein the voltage is not in excess of 350 volts.

13. The coating of claim 12 wherein the voltage is not in excess of 250 volts.

14. The coating of claims 1, 2, 5, 6, 7, 8, 9, 11 or 12 wherein the glassy oxide layer has a surface layer which is porous and of substantially open structure.

15. The coating of claim 1 wherein the rectifiable metal of the first layer is aluminum or an aluminum alloy.

16. The coating of claims 1, 4, 5, 6, 7, 8, 9, 10, 11 or 12 wherein the first layer comprises particles of graphite, refactory oxides or carbides, nitrides and borides, metal nitrides, silicides or borides.

17. The coating of claims 1, 4, 5, 6, 7, 8, 9, 10, 11, 12 or 15 wherein the glassy oxide layer comprises $SiO_2$ in a glassy state.

18. The coating of claims 1, 2, or 3 including a layer of a porous, substantially open structure on said second layer.

19. A coating on an intrinsic rectifier metal surface or on an induced rectifier metal surface or on a non-metal surface which coating has improved corrosion, temperature and abrasion resistance which coating consists of two layers, a first cured layer which comprises phosphate ions and ions selected from the group consisting of chromate and molybate ions and a rectifiable metal bonded therein and a second porous layer bonded on said first layer by silicodizing at a voltage not in excess of 500 volts for an induced rectifier metal surface, and at a voltage not in excess of 400 volts for an intrinsic rectifier metal surface.

* * * * *